US011377241B2

(12) United States Patent
Finzo

(10) Patent No.: US 11,377,241 B2
(45) Date of Patent: Jul. 5, 2022

(54) STRAPPING DEVICE

(71) Applicant: ITATOOLS S.r.l., Origgio (IT)

(72) Inventor: Flavio Finzo, Würenlos (CH)

(73) Assignee: ITATOOLS S.r.l., Origgio (IT)

( * ) Notice: Subject to any disclaimer, the term of this patent is extended or adjusted under 35 U.S.C. 154(b) by 92 days.

(21) Appl. No.: 16/856,694

(22) Filed: Apr. 23, 2020

(65) Prior Publication Data

US 2020/0339290 A1 Oct. 29, 2020

(30) Foreign Application Priority Data

Apr. 24, 2019 (IT) ..... 102019000006288

(51) Int. Cl.
*B65B 13/22* (2006.01)
*B65B 13/32* (2006.01)
*B65B 13/18* (2006.01)

(52) U.S. Cl.
CPC ..... *B65B 13/22* (2013.01); *B65B 13/187* (2013.01); *B65B 13/322* (2013.01); *B65B 13/327* (2013.01)

(58) Field of Classification Search
CPC ..... B65B 13/02; B65B 13/22; B65B 13/187; B65B 13/32; B65B 13/322; B65B 13/327
USPC ..... 100/29, 32, 33 R, 33 PB
See application file for complete search history.

(56) References Cited

U.S. PATENT DOCUMENTS 5,379,576 A * 1/1995 Koyama ..... B65B 13/22 100/26
6,109,325 A 8/2000 Chang
6,328,087 B1 12/2001 Finzo et al.
8,281,711 B2 * 10/2012 Haberstroh ..... B65B 13/18 100/26
9,284,080 B2 * 3/2016 Neeser ..... B65B 13/187
2011/0056392 A1 3/2011 Neeser et al.
(Continued)

FOREIGN PATENT DOCUMENTS

EP 2285691 B1 3/2015
WO 2018140867 A1 8/2018

OTHER PUBLICATIONS

The Italian Search Report issued for corresponding Italian Patent Application No. 201900006286, completed on Nov. 22, 2019, four pages.

(Continued)

*Primary Examiner* — Jimmy T Nguyen
(74) *Attorney, Agent, or Firm* — Vorys, Sater, Seymour and Pease LLP; Anthony Venturino

(57) ABSTRACT

Strapping device including: frame defining supporting area to place thereon a strap being processed, tensioning assembly to lock and tension, on command, at least part of the strap, welding assembly for joining, on command, at least two edges of the strap, a first drive member to actuate at least part of the tensioning and welding assemblies, and second drive mechanism operatively connected to at least the first drive member, at least part of the tensioning assembly and the welding assembly, and including a first element to carry out at least first and second movements, the first element defining an intermediate position relative to the frame starting from which the drive member actuates at least part of the tensioning assembly if the first element carries out the first movement and alternately actuates at least part of the welding assembly if the first element carries out the second movement.

10 Claims, 6 Drawing Sheets

(56) References Cited

U.S. PATENT DOCUMENTS

| | | | | |
|---|---|---|---|---|
| 2014/0083311 | A1 | 3/2014 | Bonifazi et al. | |
| 2014/0311363 | A1 | 10/2014 | Leppert | |
| 2015/0210411 | A1* | 7/2015 | Finzo | B65B 13/025 100/29 |
| 2018/0194497 | A1 | 7/2018 | Finzo et al. | |

OTHER PUBLICATIONS

The Italian Search Report issued for corresponding Italian Patent Application No. 201900006288, completed on Nov. 22, 2019, two pages.

* cited by examiner

STRAPPING DEVICE

FIELD OF THE INVENTION

The present invention relates to a strapping device of the type comprising: a frame defining a supporting area on which a strap being processed can be placed, a tensioning assembly suitable to lock and tension, on command, at least part of the strap, a welding assembly suitable for joining, on command, at least two edges of the strap, at least a first drive member suitable to actuate at least part of the tensioning assembly and the welding assembly, and a second drive mechanism operatively connected to at least the first drive member, at least part of the tensioning assembly and the welding assembly, and including at least a first element operable in such a way as to carry out at least a first movement and a second movement.

DESCRIPTION OF THE PRIOR ART

In particular, the present invention relates to an at least semi-automatic, preferably automatic, strapping device suitable for allowing the common operations of tensioning a strap and coupling two edges of said strap through welding.

As is known, in the sector relating to the transport and packaging of goods, for example with polymeric films of different thickness or simple cardboard containers, polymeric tapes or bands called straps are used in order to seal or securely close the packages of the aforementioned goods.

In order to perform their function, the straps are tensioned on the package and joined, at the ends, so as to lock said straps on the package.

The tensioning and welding operations, in particular, cannot be carried out by hand by an operator, but require specific tools called strapping devices.

Strapping devices are automatic or semi-automatic machines used to seal a certain product, as mentioned, for transport purposes, which perform their tensioning action both vertically and horizontally.

Essentially, strapping devices include at least one welding assembly and one tensioning assembly.

The welding assembly includes a mechanism suitable for locking at least two edges of the strap so as to join them at a fixed point. The joining is therefore usually carried out by subjecting the locked edges to a continuous kinematic action, which is suitable for generating friction, thereby generating the heat required for the melting and joining of the tape.

At the end of the joining operation, the operator can unlock the mechanism, and therefore also the strap, by means of a mechanical lever or, more rarely, an electronic button.

The tensioning assembly, on the other hand, includes a unit rocking around an axis arranged in an advanced position on the strapping device, and precisely referred to as a rocker.

The rocker locks at least two edges of the strap by friction and subjects them to an opposing tensioning force, delivered through a rotating roller, so that the portions of the strap slide one over the other until a predetermined tension state is reached over the entire tape.

This operation is also carried out by the command of an operator, usually at least one electronic button, which gives the order of locking and tensioning the strap.

The rocker mechanism includes a plurality of drive elements which are suitable to transmit motion from a motor to the rocker and from the rocker to the tensioning roller.

Therefore, conventionally, the strapping device comprises a motor for driving the welding assembly, a motor for driving the tensioning assembly, and a mechanical lever, or a servomotor, for unlocking the strap when the joining is completed.

The described prior art has a few major drawbacks.

In particular, the current strapping devices include a plurality of independent commands which require their own motors and mechanisms, resulting in increased overall dimensions of the strapping device.

This aspect is very significant as automatic and semi-automatic strapping devices are usually battery operated and are aimed at improving the portability of the strapping device. However, even today, the size and weight of the strapping devices are by no means negligible.

In addition, the tensioning assembly usually has complex configurations, including at least four or five stages of transmission, which can lead to reductions in available torque and to high expenditure of energy required, especially with regard to battery-operated strapping devices.

A further drawback of the prior art is that common strapping devices do not take into account a factor which is important for providing quality seals: the human factor.

Very often, due to the rush in ending the packing and sealing operations, the operator commands the release of the strap before the time required for the solidification of the area thermally altered by the welding. This seemingly harmless release, instead, causes a release in tension of the polymer tape and compromises the safety of the seal.

However, strapping devices do not prevent or in any way help the operator during the release of the strap.

In this context, the technical task underlying the present invention is to devise a strapping device, which is capable of substantially obviating at least some of the above-mentioned drawbacks.

Within the scope of said technical task, a major object of the invention is to obtain a strapping device which allows a reduction in the complexity and the mechanical components inside the control assemblies, i.e. the welding and/or tensioning assemblies, while maintaining high processing efficiency.

Another major object of the invention is to provide a strapping device which is able to increase the torque for locking the rocker, so as to guarantee greater locking stability even in the case of tension forces greater than the norm.

In conclusion, a further task of the invention is to provide a strapping device which assists the operator at least during the unlocking of the strap, so as to prevent, or at least reduce, defective and yielding seals.

SUMMARY OF THE INVENTION

The technical task and the specified objects are achieved by means of a strapping device of the type comprising: a frame defining a supporting area on which a strap being processed can be placed, a tensioning assembly suitable to lock and tension, on command, at least part of the strap, a welding assembly suitable for joining, on command, at least two edges of the strap, at least a first drive member suitable to actuate at least part of the tensioning assembly and the welding assembly, and a second drive mechanism operatively connected to at least the first drive member, at least part of the tensioning assembly and the welding assembly, and including at least a first element operable in such a way as to carry out at least a first movement and a second movement, the first element defining at least one intermediate position with respect to the frame starting from which the drive member actuates at least part of the tensioning assembly if the first element carries out the first movement and alternately actuates at least part of the welding assembly if the first element carries out the second movement.

BRIEF DESCRIPTION OF THE DRAWINGS

The features and advantages of the invention will be apparent from the detailed description of preferred embodiments of the invention, with reference to the accompanying drawings, in which.

DESCRIPTION OF THE PREFERRED EMBODIMENTS

Figure 1:
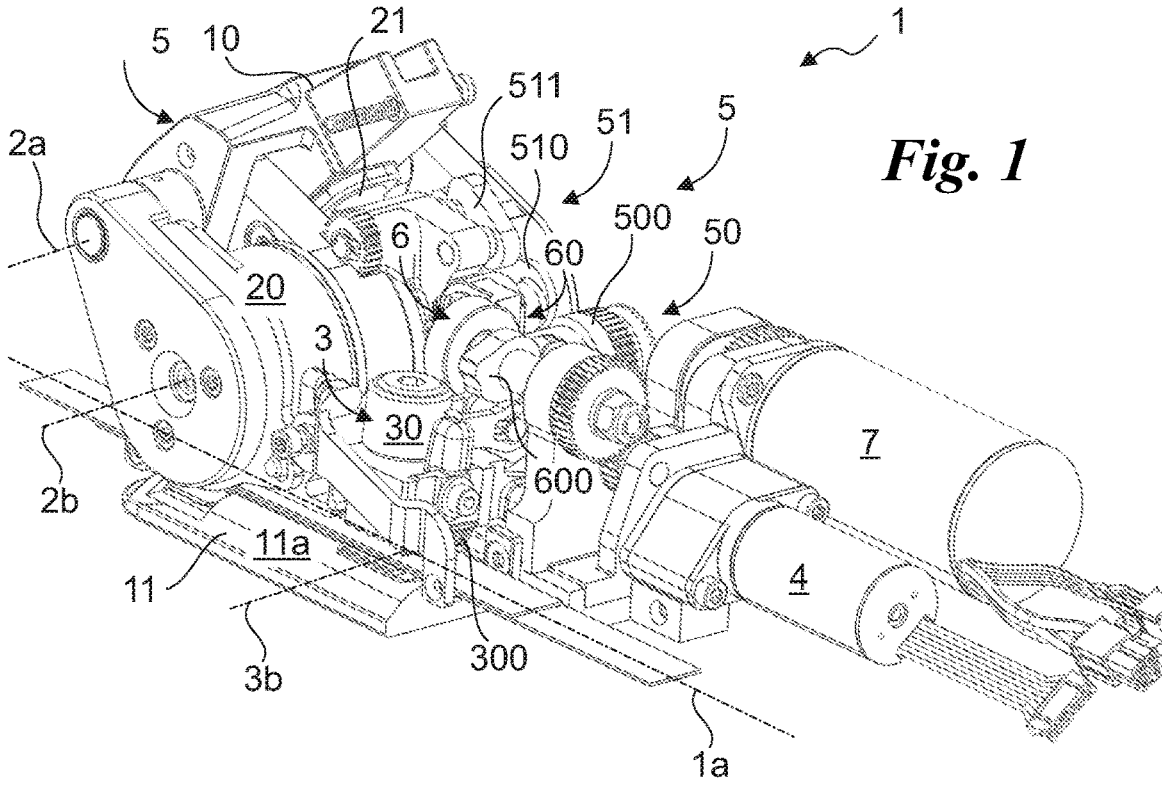
FIG. 1 is a perspective view of the strapping device according to the invention.

Herein, the measures, values, shapes and geometric references (such as perpendicularity and parallelism), when used with words like "about" or other similar terms such as "approximately" or "substantially", are to be understood as except for measurement errors or inaccuracies due to production and/or manufacturing errors and, above all, except for a slight divergence from the value, measure, shape or geometric reference with which it is associated. For example, these terms, if associated with a value, preferably indicate a divergence of not more than 10% from said value.

Furthermore, when used, terms such as "first", "second", "upper", "lower", "main" and "secondary" do not necessarily refer to an order, a priority relationship or a relative position, but may simply be used to more clearly distinguish different components from each other.

Unless otherwise indicated, the measurements and data provided herein are to be considered as carried out in International Standard Atmosphere ICAO (ISO 2533:1975).

With reference to the Figures, the strapping device according to the invention is indicated as a whole by the numeral 1.

Substantially, the strapping device 1 is a tool which allows a user, typically an operator, to seal packages by means of long-shaped or tape elements known as straps.

Straps, which are widely used in the packaging sector, are polymeric bands designed to enclose the object to be packaged so as to seal the package.

In particular, the strapping device 1 is suitable to tension the strap and weld the strap at a predetermined point of the strap itself. In order to carry out the welding and the tensioning, the strapping device is provided with a guide area in which two spaced apart edges of the strap are arranged and superimposed.

While one of the edges is substantially blocked, the other edge of the strap is moved so as to subject the strap to a desired tension. Subsequently, the opposite portions of the two edges of the strap are subjected to friction and mutually welded by the effect of the heat produced by the friction.

The foregoing general description of the strap 1 is detailed below in the embodiment aspects relevant for the purposes of the invention. In order to provide the strapping device 1 according to the invention, it is good to keep in mind what is already known to the person skilled in the art and what is already present in the current state of the art.

In this respect, an example of a strapping device similar to the strapping device 1 is the ITA 27 product marketed by Itatools™. Other similar examples are described in patent applications US-A-2018194497 and EP-A-2285691.

Preferably, moreover, the strapping device 1 is battery operated, but could also be powered in a different way, as long as it is functional to the invention.

The strapping device 1 preferably comprises a tensioning assembly 2 and a welding assembly 3. Preferably, the tensioning assembly 2 and the welding assembly 3 are constrained to a frame 10. Furthermore, the strapping device 1 is preferably provided with a body suitable for covering at least part of the tensioning assemblies 2, the welding assembly 3 and the frame 10.

The frame 10 is preferably a structure suitable to house the components that make up the strapping device 1 so as to constrain them. Obviously, the frame 10 can be in one piece, or in several pieces, in turn constrained to each other.

The frame 10 therefore also defines a supporting area 11. The supporting area 11 is a portion of the frame 10 within which, normally, the strap is processed by the strapping device 1.

Therefore, commonly, the strapping device 1 also defines a supporting surface 11*a*. The supporting surface 11*a* is substantially a portion, which is for example flat or with a small curvature, of the supporting area 11 in which the strap to be processed is positioned. Furthermore, the strap itself therefore defines a processing path 1*a* preferably at least partially aligned with the supporting surface 11 along which the strap is positioned.

The tensioning assembly 2 preferably comprises all the components suitable to allow the tensioning of the strap, that is, all the components acting directly in contact with the strap, as well as all the components suitable to transmit the energy or motion required to actuate the components contacting the strap.

Therefore, the tensioning assembly 2 is preferably suitable to lock and tension, on command, at least part of a strap. Therefore, the tensioning assembly 2 comprises at least one rocker 20.

The rocker 20, as suggested by the term, is an element substantially designed to rock, i.e. rotate, on command, around a predetermined axis. Therefore, preferably, the rocker 20 defines a main axis 2*a*.

The main axis 2*a* is preferably the axis around which the rocker 20 can rotate relative to the frame 10 of the strapping device 1. Preferably, the main axis 2*a* is substantially transverse to the processing path 1*a* of the strap so that, by rotating around the main axis 2*a*, the rocker 20 can move towards or away from the strap. The rocker 20, in turn, includes at least one tensioning wheel 200.

The tensioning wheel 200 is preferably a rotating component suitable to allow the movement, on command, of the strap so as to tension it. The tensioning wheel 200, in particular, is not the element in contact with the strap, but is the element that allows a tensioning roller to be moved.

The latter, as known in the current state of the art, is a cylindrical element capable of rotating, for example, adherent to the strap to tension it, and is therefore moved by the tensioning wheel 200. The tensioning wheel 200 can therefore move the tensioning roller directly, or can move it by means of drive means, for example including epicyclic gears.

Figure 2:
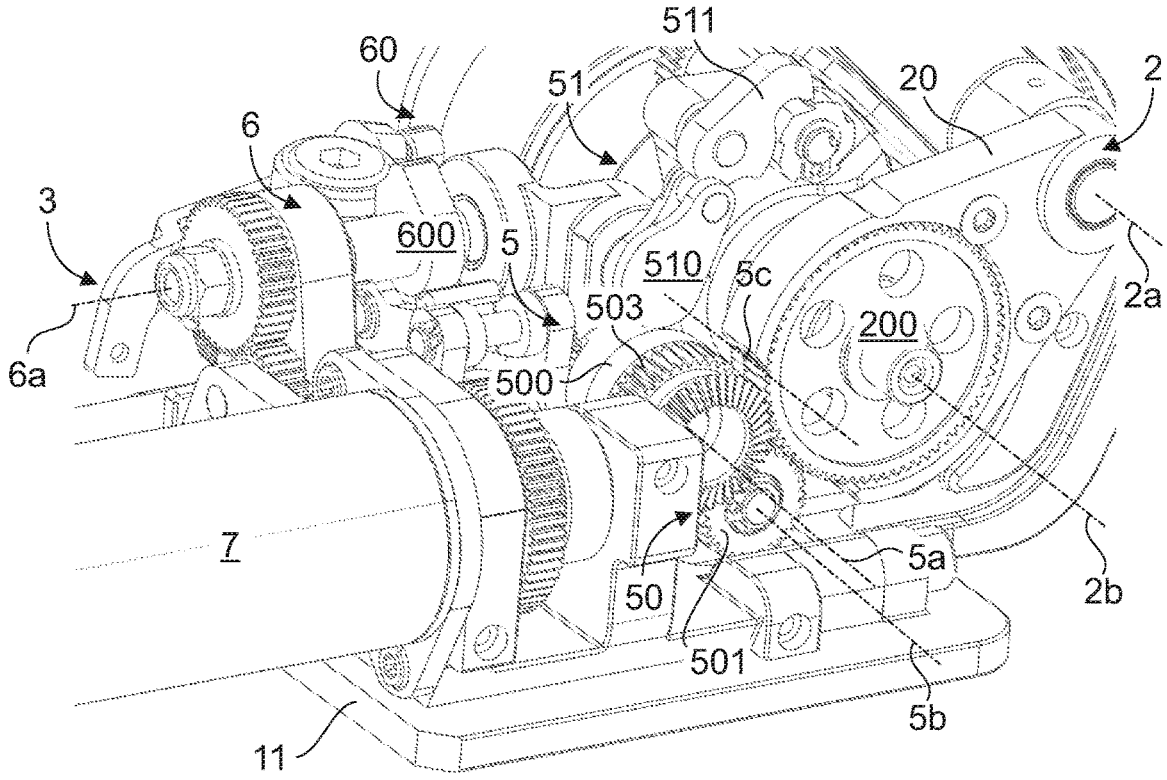
FIG. 2 shows a perspective detail of the first drive mechanism and the rocker of a strapping device according to the invention.
Figure 3A:
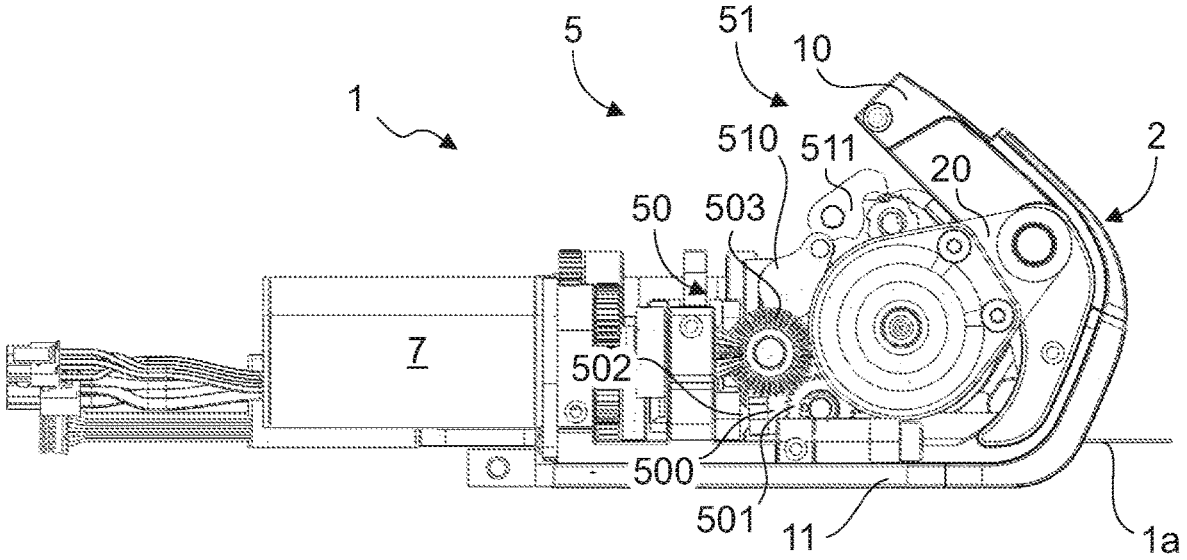
FIG. 3*a* is a side view of a strapping device according to the invention, with the rocker far from the supporting area of the strap.
Figure 3B:
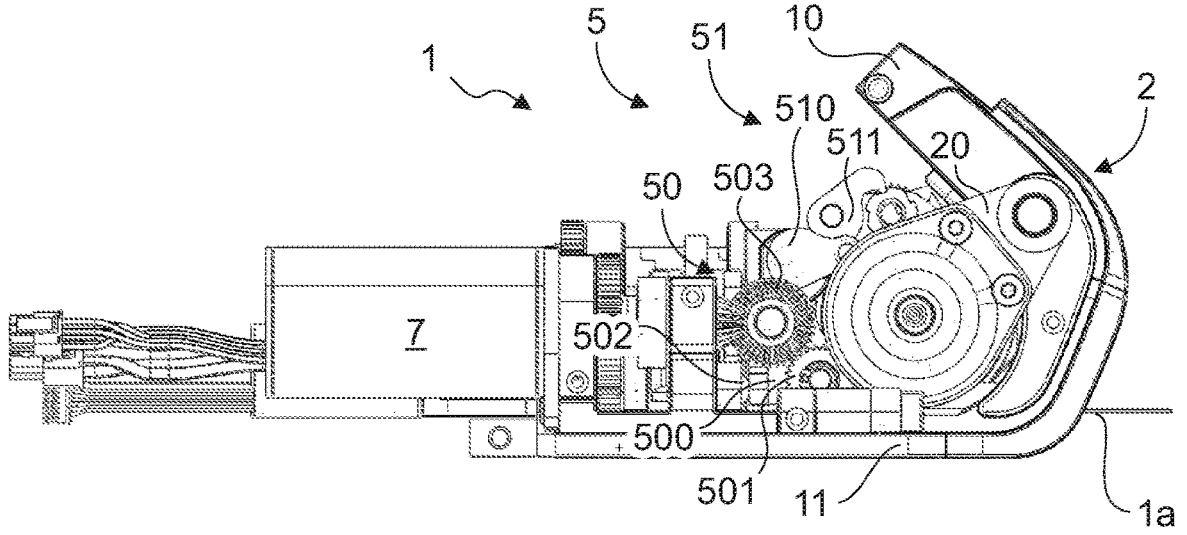
FIG. 3*b* is a side view of a strapping device according to the invention, with the rocker close to the supporting area of the strap.
Figure 4A:
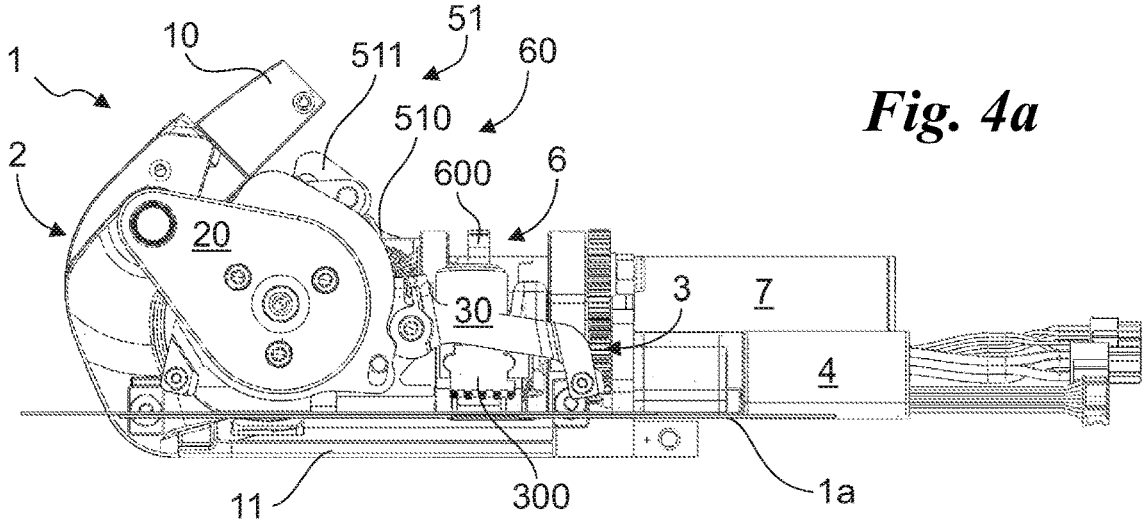
FIG. 4*a* is a side view of a strapping device according to the invention, wherein the first element of the second drive mechanism is in the extreme position defined by the first movement, with the rocker and the interface device far from the area supporting the strap.
Figure 4B:
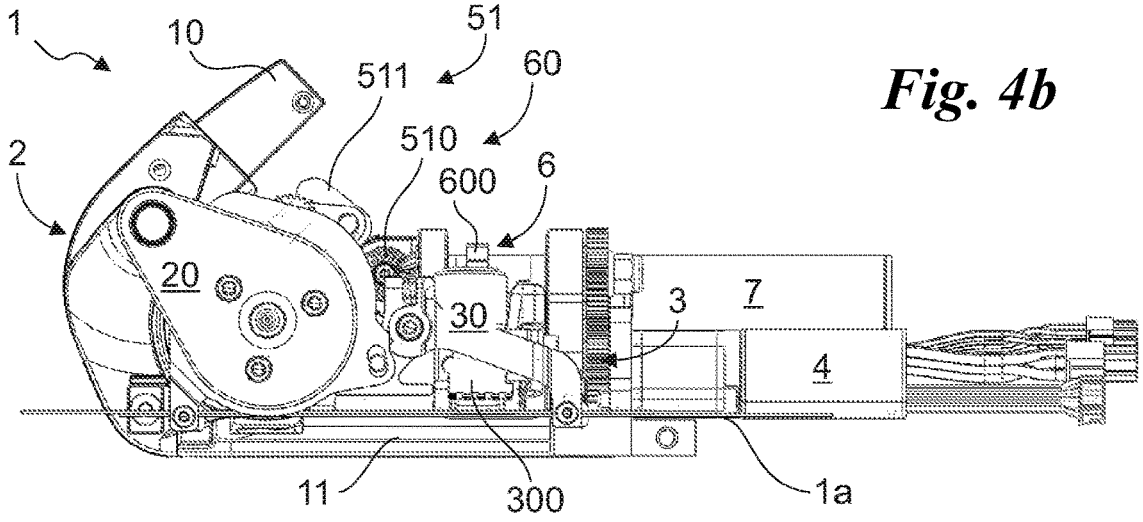
FIG. 4*b* is a side view of a strapping device according to the invention, wherein the first element of the second drive mechanism is in the intermediate position, with the rocker close to the area supporting the strap, and the interface device far from the area supporting the strap.
Figure 4C:
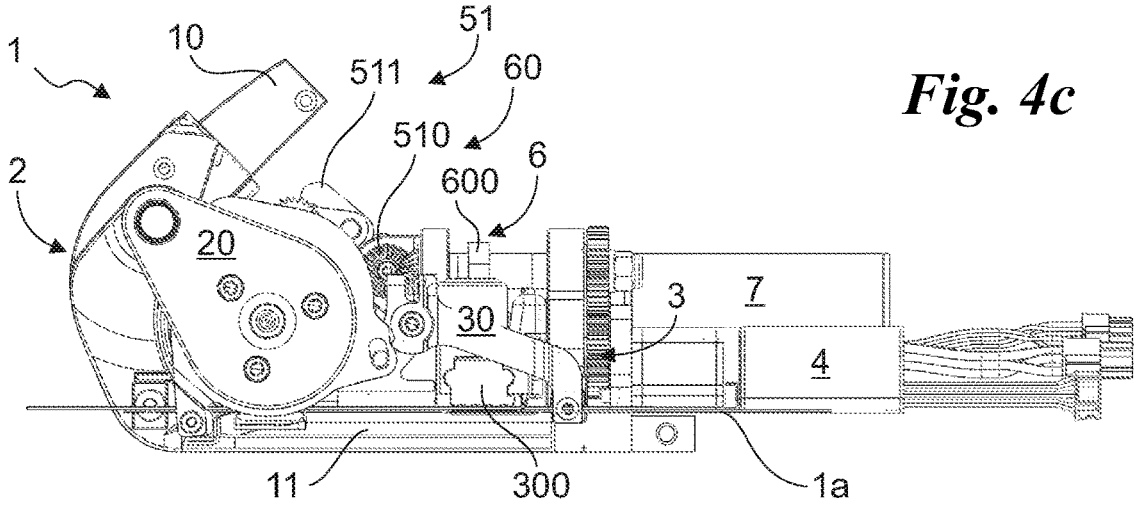
FIG. 4*c* is a side view of a strapping device according to the invention, wherein the first element of the second drive mechanism is in the extreme position defined by the second movement, with the rocker and the interface device close to the area supporting the strap.
Figure 5:
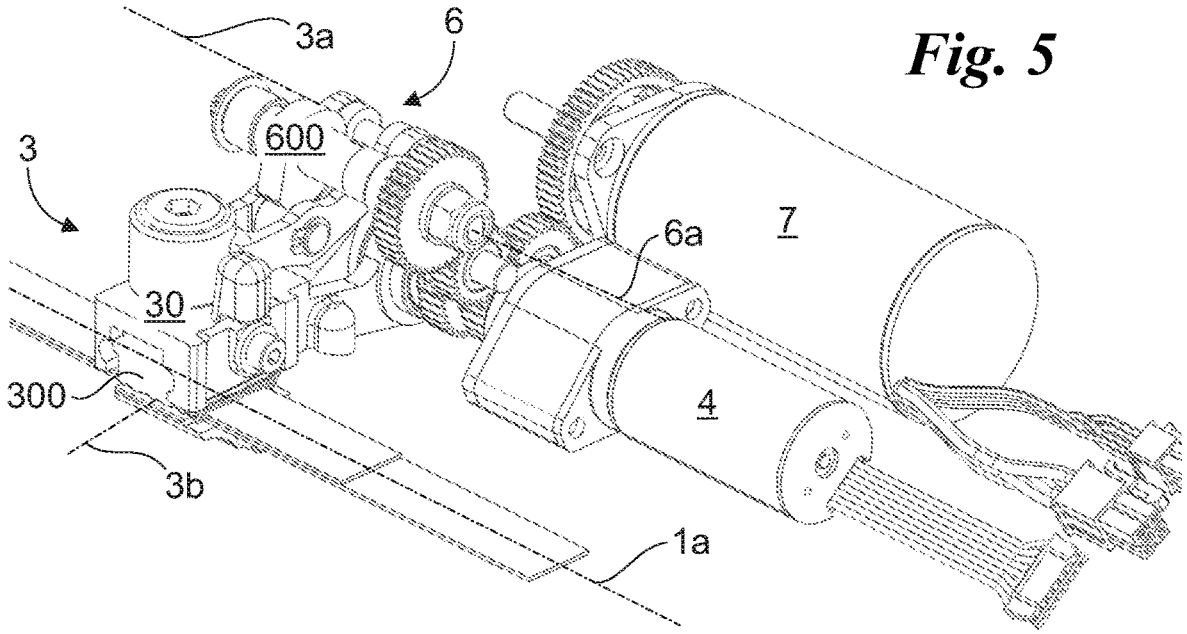
FIG. 5 represents a detail, without the frame, of part of the second drive mechanism, the welding assembly and the drive members of a strapping device according to the invention.
Figure 6:
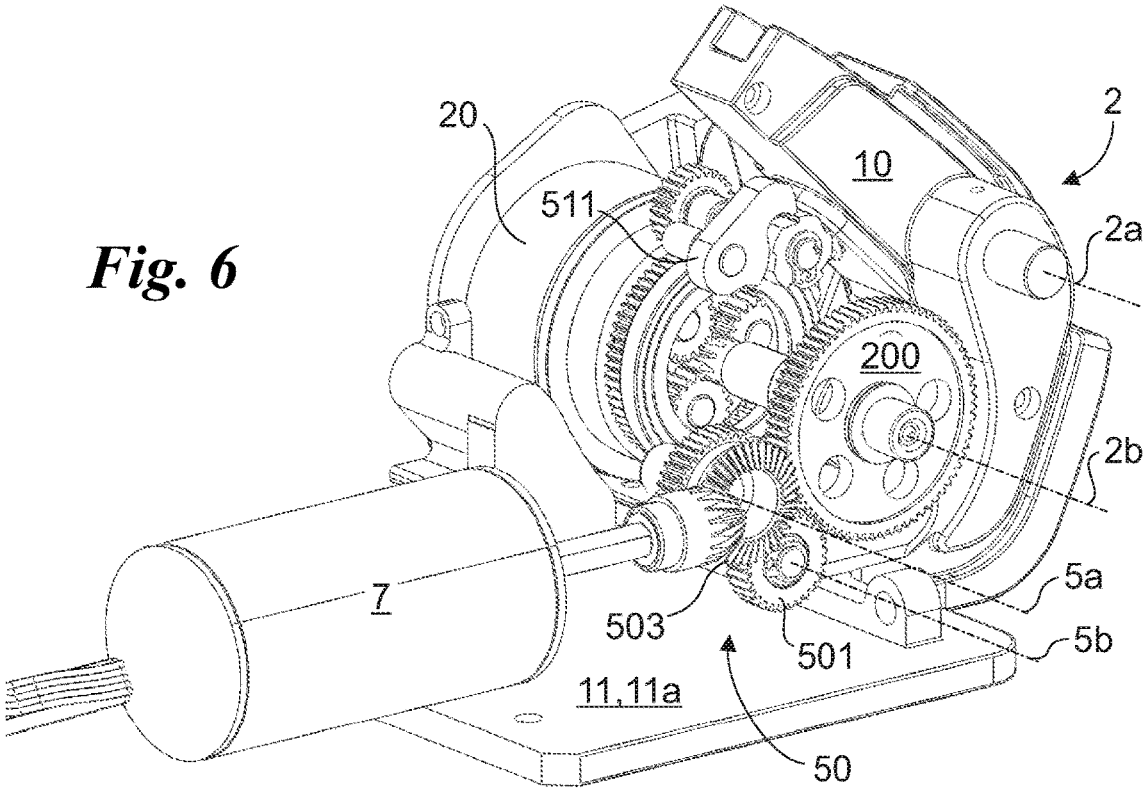
FIG. 6 shows a detail of part of the frame with part of the first drive mechanism, the tensioning assembly and the second drive member of a strapping device according to the invention.
Figure 7:
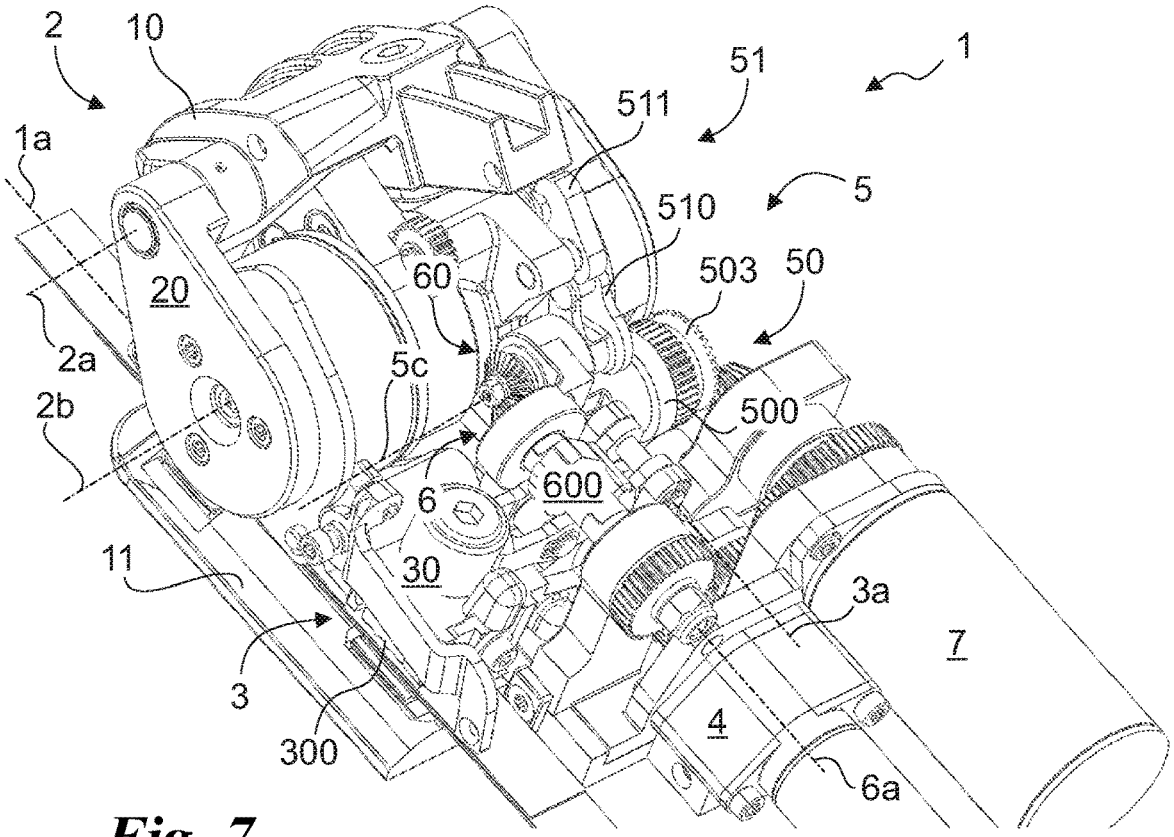
FIG. 7 shows a detail of the connection between the first element included in the second drive mechanism and the second drive assembly of the first drive mechanism of a strapping device according to the invention.

Preferably, the tensioning wheel 200 is a main driving gear of the tensioning roller shown clearly in FIG. 2.

From now on, in the description, when the tensioning wheel 200 is mentioned, it is assumed that the tensioning roller moves integrally therewith or as a consequence of the movement of said wheel.

In the current state of the art, usually, the tensioning wheel 200 and the tensioning roller, by virtue of the transmission of motion, rotate in opposite directions around the same axis, but move integrally with each other in the plane perpendicular to the axis of rotation.

Therefore, preferably, when the tensioning roller adheres to the strap to tension it, the tensioning wheel 200 is moved closer to the strap, whereas when the tensioning roller is moved away from the strap, so is the tensioning wheel 200.

The tensioning wheel 200 is therefore adapted to rotate around its own tensioning axis 2*b*.

The tensioning axis 2*b* is preferably an axis parallel to the main axis 2*a* and is substantially centred with respect to the tensioning wheel 200.

In addition, preferably, the tensioning axis 2*b* is spaced apart with respect to the main axis 2*a* so that the tensioning wheel 200 can be moved with at least two degrees of freedom.

In particular, preferably, the tensioning wheel 200 is able to rotate on its axis, in detail around the tensioning axis 2*b*, so as to tension a possible strap in contact with the tensioning roller moved by the tensioning wheel 200, and is capable of translating along a curvilinear path, substantially an arc of a circle, when the tensioning wheel 200 rotates with respect to the main axis 2*a*.

Substantially, therefore, the rocker 20 is adapted to be moved towards the strap, so as to arrange the tensioning roller adherent to the strap, or far from the strap.

Of course, when the tensioning roller adheres to the strap, the tensioning wheel 200 also moves towards the strap integrally with the tensioning roller, without touching the strap, since it is a member designed to transmit motion.

Therefore, in other words, the rocker 20 is adapted to be moved towards the strap, so as to arrange the tensioning wheel 200 close to the strap, or far from the strap. The welding assembly 3 is preferably suitable for joining, on command, at least two edges of a strap. In particular, the welding assembly 3 is preferably of the type commonly used for vibration welding.

Therefore, substantially, the welding assembly 3 comprises at least one interface device 30. The interface device 30 is substantially a mobile portion of the welding assembly 3 suitable for interacting with the strap so as to transfer at least part of the energy powering the strapping device 1 to the strap in the form of heat. Preferably, the interface device 30 can be active or can be inactive with respect to the strap. Typically, the interface device 30 is active when it interacts with the strap and is inactive when the strap is not subjected to welding.

In particular, the interface device 30 is adapted to collaborate with a welder 300. The welder 300 preferably defines the area of contact with the strap. Preferably, therefore, the interface device 30 can be adapted to push the welder 300 towards the strap, so as to allow the welder 300 to exert the pressure required to carry out the welding operations, or it can be moved away from the strap so that the welder 300 does not adhere to the strap or moves away from it.

The welder 300 is therefore preferably constrained to the frame 10 and configured so as to collaborate with the interface device 30. Preferably, in this case, the welder 300 is constrained at the supporting area 11, possibly in a housing obtained on the supporting surface 11*a* itself.

In an alternative configuration to that described above, the welder 300 can simply be arranged on the interface device 30 itself. In this case, the welder 300 defines an area of contact with the strap of the interface device 30 itself. However, in this alternative embodiment, the welder 300 always moves integrally with the interface device 30.

In the preferred embodiment, the interface device 30 and the welder 300 are only partially mutually integral.

In any case, preferably, the welder 300 is adapted to provide heat for joining the edges of the strap. Preferably, the welder 300 is adapted to produce heat by rubbing on the surface contacting the edges of the strap.

In this regard, the welder 300 can preferably define its own vibration axis 3*b*. The vibration axis 3*b*, for example, is an axis substantially perpendicular or parallel to the processing path 1*a*. In general, the vibration axis 3*b* is preferably aligned with the supporting surface 11*a* so as to move the welder 300 coplanar with respect to the supporting surface 11*a*.

However, the welder 300 may not necessarily move coplanar with respect to the supporting surface 11*a*, but may be inclined relative thereto. The supporting surface 11*a* itself could therefore include a cavity for housing the welder 300 so as to provide a guide inside which the welder 300, when in contact with the strap, can friction-weld the strap by also moving outside the plane provided by the supporting surface 11*a*.

Preferably, the welder 300 moves by cyclically translating along the vibration axis 3*b*, like a vibrating slider, so as to provide the heat required for joining the edges of the strap.

Of course, as is known to those skilled in the art, the welder 300 can be made according to several embodiments. It can be suitable for making movements different from those described, for example circular, or sector of a circle-like, or other movements. In general, the welder 300 is adapted to be moved with respect to the strap arranged on the supporting surface 11*a* and, for example, blocked by the rocker 20, so as to provide heat by friction.

A shearer can also be coupled to the welder 300. The shearer, as is known, is preferably adapted to allow the sectioning of part of the strap once the welding operations are completed so as to remove the portion of the strap that does not provide, for example, the packing ring.

The shearer can also be arranged on the interface device 30 integral therewith, or only partially integral therewith, in greater detail it can collaborate with it so that the interface device 30, when required, pushes the shearer towards the strap.

The interface device 30 therefore preferably defines a secondary axis 3*a*.

The secondary axis 3*a* is preferably a movement axis suitable to allow at least part of the interface device 30 to be moved with respect to the frame 10 of the strapping device 1.

In particular, preferably, the interface device 30 moves so as to push the slider 300 towards the strap so that the slider 300 is substantially moved eccentrically with respect to the secondary axis 3*a*.

Furthermore, preferably, the secondary axis 3*a* is preferably parallel to the processing path 1*a* of the strap, and therefore the slider 300, similar to the tensioning wheel 200, can translate along a curvilinear path, substantially in arcs of a circle, moving towards and away from the strap.

Of course, the strapping device 1 could have systems for moving the interface device 30 linearly, and in this case, the slider 300 could move by translating along a direction perpendicular to the supporting surface 11*a*.

In general, both the rocker 20 and the interface device 30 are adapted, at least partially, to move towards and away from the supporting area 11 of the frame 10, in order to allow the strap to be processed, directly or indirectly.

In detail, respectively, the tensioning wheel 200 and the welder 300 are adapted to move towards and away from the supporting surface 11*a*, and therefore towards and away from the strap itself being processed.

In order to actuate the tensioning 2 and welding 3 assemblies, the strapping device 1 can be provided with a plurality of different drive members and drive means.

Preferably, the strapping device 1 comprises at least a first drive member 4.

The first drive member 4 is at least adapted to actuate at least part of the tensioning assembly 2. Preferably, the first drive member 4 is also adapted to actuate part of the welding assembly 3.

Preferably, the first drive member 4 is any device that allows kinetic energy to be transmitted to a system starting from electrical energy. In fact, the strapping device 1, as said, can be battery or current operated, and in any case is capable of exploiting electrical energy to actuate the assemblies 2, 3.

Conveniently, the first drive member 4 comprises at least one electric motor. Furthermore, this electric motor can be linear or rotary. Preferably, the drive member 4 is adapted to transmit rotary motion through a drive shaft and, for example, through a crown or gear arranged on said shaft.

Preferably, the strapping device 1 also comprises a second drive member 7.

The second drive member 7 is substantially similar to the first drive member 4 and has the same structural features.

However, the first and second drive members 4, 7 could differ in the number of motor revolutions. Therefore, either one or both could also include reduction members.

The second drive member 7, like the first drive member 4, is preferably adapted to actuate at least part of the tensioning assembly 2 and at least part of the welding assembly 3. Clearly, the second drive member 7 could also be adapted to actuate at least part of only one of the tensioning assembly 2 and the welding assembly 3. Preferably, the first drive member 4 and the second drive member 7 are adapted to actuate the tensioning 2 and welding 3 assemblies in a different way and for different functions.

In particular, in a preferred but not exclusive embodiment, the first drive member 4 is adapted to move the rocker 20 and/or the interface device 30 towards or away from the strap. In other words, the first drive member 4 is adapted to move the rocker 20 and/or the interface device 30 towards or away from the supporting area 11.

Therefore, preferably, the first drive member 4 moves the rocker 20 by rotating it with respect to the frame 10 around the main axis 2*a* and moves the interface device 30 by rotating it around the secondary axis 3*a* with respect to the frame 10. The second drive member 7, on the other hand, is preferably adapted to actuate the tensioning wheel 200 and the welder 300. In particular, the actuation of the tensioning wheel 200 and the welder 300 is preferably provided when the rocker 20 and the interface device 30, respectively, are brought closer to the supporting area 11. In this case, the tensioning roller moved by the tensioning wheel 200 and/or the welder 300 are adherent to the strap, or the edge of the strap, so as to allow processing. In particular, the tensioning wheel 200, in this situation, rotates around its own tensioning axis 2*b*, whereas the welder 300 cyclically translates along the vibration axis 3*b*.

The actuation of the tensioning 2 and welding 3 assemblies, as well as the various constituent parts, i.e. the rocker 20 and the tensioning wheel 200, or the interface device 30 and the welder 300, can be performed simultaneously or selectively. In fact, it is not necessary to actuate the tensioning assembly 2 and the welding assembly 3 together, just as it is not necessary to actuate the tensioning wheel 200 and the rocker 20 simultaneously.

In order to transmit motion from the drive members 4, 7 to the assemblies 2, 3, as already mentioned, drive means are provided.

The strapping device 1 therefore comprises a first drive mechanism 5.

The first drive mechanism 5 is preferably operatively connected to at least part of the first drive member 4.

Furthermore, the first drive mechanism 5, in the preferred embodiment, is also operatively connected to the second drive member 7.

Therefore, substantially, the first drive mechanism 5 preferably allows, at least in part, actuation of the rocker 20 and the tensioning wheel 200 integrally with the rocker 20, as well as of the tensioning wheel 200 around its own tensioning axis 2*b*.

Preferably, the first drive mechanism 5 is adapted to simultaneously or alternately move the tensioning wheel 200 around the main axis 2*a* and the tensioning axis 2*b* when actuated.

In particular, the first drive mechanism 5 comprises at least a first drive assembly 50 and a second drive assembly 51.

The first drive assembly 50 preferably moves the tensioning wheel 200 around the tensioning axis 2*b*.

Advantageously, the first drive assembly 50 moves the tensioning wheel 200 around the tensioning axis 2*b* even when the tensioning wheel 200 is moved around the main axis 2*a*.

In other words, the first drive assembly 50 is adapted to follow the movement of the tensioning wheel 200 when the latter is moved.

In an alternative configuration, the first drive assembly 50 could even be adapted to simultaneously or alternately move the tensioning wheel 200 around the main axis 2*a* and the tensioning axis 2*b* when actuated.

In order to accomplish this function, the first drive assembly 50 preferably includes a first component 500.

The first component 500, preferably, is the component suitable to allow the following of the tensioning wheel 200, when the latter is moved around the main axis 2*a*, in order to allow the movement thereof around the tensioning axis 2*b*. In the preferred embodiment, the first component 500 is a rotating element, substantially a lever. Therefore, the first component 500 preferably defines a first axis of rotation 5*a*.

The first axis of rotation 5*a* is substantially parallel to and spaced apart from the main axis 2*a* and the tensioning axis 2*b*.

The first axis of rotation 5*a* also allows the first component 500 to rotate so as to describe a curvilinear path, preferably an arc-of-a-circle path.

Furthermore, with respect to the first component 500, the first axis of rotation 5*a* is neither barycentric nor the main inertia axis. Therefore, as already disclosed, the first component 500, when rotated around the first axis of rotation 5*a*, behaves like a lever.

In particular, preferably, when the first component 500 rotates around the first axis of rotation 5*a*, it follows part of the tensioning assembly 2 so as to interfere, in each configuration of the strapping device 1, with part of the tensioning assembly 2, and in particular, with the rocker 20.

Schematically, the first component 500 substantially defines a drive arm, whereas the rocker 20 defines a rocker arm.

The arms behave like levers with fulcra in the first drive axis 5*a* and the main axis 2*a*, respectively. The interaction between the drive arm and the rocker arm, and therefore between the first component 500 and the rocker 20, substantially takes place at the free ends of the arms.

The free ends of both arms face the supporting area 11 starting from the first drive axis 5*a* and the main axis 2*a*, respectively.

Preferably, the free ends of the drive arm and the rocker arm are substantially always in contact so that, when the rocker arm, and therefore the tensioning wheel 200, is moved away from the supporting area 11, the drive arm, and therefore the first component 500, also moves away from the supporting area 11.

When the arms follow each other, in particular, the first component 500 slides between the tensioning wheel 200 and the supporting area 11 and is therefore closer to the supporting area 11 than the tensioning wheel 200.

Obviously, in an alternative embodiment, the first component 500 could slide over the tensioning wheel 200 so that the tensioning wheel 200 is closer to the supporting area 11 than the first component 500.

Preferably, the first component 500 comprises a second component 501.

The second component 501 is the portion of the first component 500 directly in contact with the tensioning wheel 200 so as to interfere with the tensioning wheel 200. Therefore, preferably, the second component 501 is positioned near the free end of the drive arm.

The second component 501 therefore defines, in turn, a drive axis 5*b*.

The drive axis 5*b* is preferably parallel to the first axis of rotation 5*a*. Furthermore, the drive axis 5*b* is spaced apart from the first axis of rotation 5*a*.

Preferably, the second component 501 is centred with respect to the drive axis 5*b*, and therefore, when it is rotated with respect to the drive axis 5*b* it rotates on its axis.

In particular, preferably, the second component 501 moves the tensioning wheel 200 when it is moved with respect to the transmission axis 5*b* even when the same second component 501 is moved with respect to the first axis of rotation 5*a*, integrally with the first component 500. Obviously, the movements can be simultaneous or alternate.

In detail, the second component 501 is preferably rotatable with respect to the first axis of rotation 5*a* so as to follow the tensioning wheel 200 which is moved, in turn, around the main axis 2*a* and is simultaneously or alternately rotatable around the second drive axis 5*b* so as to rotate the tensioning wheel 200 around the tensioning axis 2*b*.

Preferably, when the tensioning wheel 200 is close to the supporting area 11, and therefore rests on the strap, the strapping device 1 is configured so that the main axis 2*a*, the tensioning axis 2*b* and the second drive axis 5*b* are not coplanar, therefore are staggered and define a scalene triangle configuration in which the greater angle is arranged at the tensioning axis 2*b*.

Preferably, the first drive assembly 50 also includes thrust means 502.

The thrust means 502 are preferably configured to provide a thrust suitable for allowing the first drive assembly 50 to follow the rocker 20.

In other words, they are preferably suitable to counter the movement of the first drive assembly 50 away from the rocker 20. In greater detail, the thrust means 502 are suitable to counter the movement of the second component 501 away from the tensioning wheel 200.

The thrust means 502 can include a torsional spring, or a linear spring, or other equivalent elements which allow a thrust force to be exerted on the first component 500.

Preferably, in fact, the thrust means 502 are constrained to the frame 10 and the first component 500 so as to push the first component 500 away from the supporting area 11 integrally with the movement of the tensioning wheel 200.

Preferably, the opposing means 502 define a load or preload condition and an unloaded condition.

The unloaded condition preferably occurs when the tensioning wheel 200 is further away from the supporting area 11, whereas the load or preload condition occurs when the tensioning roller, which can be moved by the tensioning wheel 200, holds the strap and is therefore adherent or close to the supporting area 11. In the latter case, therefore, the tensioning wheel 200 is also close to the supporting area 11.

The thrust means 502, as described above, are substantially passive means. However, in an alternative embodiment, it is also possible to provide active means suitable for providing a thrust on command.

In a second alternative embodiment, the thrust means 502 could even include a simple mechanical connection between the first component 500 and the rocker 20, for example a connection bar connecting the drive axis 5*b* to the tensioning axis 2*b*, suitable to allow the rocker 20 to drag the first component 500 along with it.

In a third alternative embodiment, an active movement of the first component 500 could also be provided, for example by connecting the latter to the first drive member 4, so as to allow the first component to exert a lever effect on the rocker 20 and drag said rocker 20 towards and/or away from the supporting area 11.

The second drive assembly 51 is preferably configured to allow the movement of at least part of the tensioning assembly 2 around the main axis 2*a*. In particular, the second drive assembly 51 allows the rocker 20 to be moved around the main axis 2*a*. In greater detail still, it preferably moves the tensioning wheel 200 around the main axis 2*a*.

The second drive assembly 51 is therefore preferably operatively connected to the first drive member 4 and the rocker 20 and adapted to move the rocker 20 around the main axis 2*a* so as to move the rocker 20 towards and/or away from the supporting area 11.

The second drive assembly 51 is preferably moved independently of the first drive assembly 50. Therefore, it can be connected to the first drive member 4, whereas the first drive assembly 50 can be connected to the second drive member 7.

Preferably, but not necessarily, the second drive assembly 51 is only operatively connected to the first drive member 4. Obviously, "operatively connected" is intended to mean that the connection can be direct or even indirect and achieved by means of other devices that can transmit motion from the drive members 4, 7 to the various parts of the drive mechanisms 5, 6 and the assemblies 2, 3.

The second drive assembly 51 preferably comprises at least one movement device 510.

The movement device 510 is preferably adapted to allow the tensioning wheel 200 to move around the main axis 2*a*. In particular, preferably, the movement device 510 is connected to part of the rocker 20 and not directly to the tensioning wheel 200.

In the preferred embodiment, the movement device 510 is a rotating element, substantially a lever. Therefore, the movement device 510 preferably defines a second axis of rotation 5*c*.

The second axis of rotation 5*c* is substantially parallel to and spaced apart from the main axis 2*a*.

The second axis of rotation 5*c* also allows the movement device 510 to rotate so as to describe a curvilinear path, preferably an arc-of-a-circle path.

Furthermore, with respect to the movement device 510, the second axis of rotation 5*c* is neither barycentric nor the main inertia axis. Therefore, as already disclosed, the movement device 510, when rotated around the second axis of rotation 5*c*, behaves like a lever.

In particular, preferably, when the movement device 510 rotates around the second axis of rotation 5*c*, part of the tensioning assembly 2, in particular the tensioning wheel 200, moves towards or away from the supporting area 11.

The second drive assembly 51 can move the rocker 20 on command and freely or move it in opposition to opposing means 21.

Preferably, the tensioning assembly 2 comprises these opposing means 21.

The opposing means 21 are partially constrained to the frame 10 and the rocker 20 and adapted to oppose the movement of the rocker 20, and therefore of the tensioning wheel 200, around the main axis 2*a*.

In particular, the second drive assembly 51 moves the rocker 20, and therefore also the tensioning wheel 200, preferably around the main axis 2*a* in opposition to the opposing means 21 when rotated with respect to the axis of rotation 5*a*.

Preferably, in greater detail still, the movement device 510 moves the rocker 20 around the main axis 2*a* in opposition to the opposing means 21, when moved away from the supporting area 11.

Therefore, for example, the opposing means 21 can include a torsional spring in the unloaded condition when the tensioning roller holds the strap and is therefore adherent or close to the supporting area 11.

Alternatively, the opposing means 21 can oppose the movement of the rocker 20 near the supporting area 11.

Furthermore, the movement device 510 can be directly or operatively connected exclusively to the rocker 20, or the second drive assembly 51 can include an adjustment device 511. In this case, the movement device 510 is directly operatively connected to the rocker 20 and indirectly operatively connected to the tensioning wheel 200.

It should be specified that "operatively connected" is not intended to mean that the movement device 510 should necessarily be physically connected to the rocker 20, but that it is simply configured so as to define at least some positions in which it operatively interferes with the rocker 20 to move it. This concept is better outlined in the description hereafter.

In fact, the adjustment device 511, if any, is preferably connected between the movement device 510 and the tensioning wheel 200. As indicated above, when speaking of the connection with the tensioning wheel 200, this means the connection with the main gear of the tensioning wheel 200. The rocker 20, and in particular the tensioning wheel 200, as already mentioned, is in fact connected to a structure known to the skilled in the art through epicyclic drive gears and other known elements which do not form the object of the present patent application.

In particular, preferably, the adjustment device 511 is suitable to allow a controlled rotation of the tensioning wheel 200.

In greater detail, the adjustment device 511 interferes with the tensioning wheel 200 when the rocker 20 is close to the supporting area 11, i.e. when the tensioning wheel 200 is arranged near the strap or, in any case, the supporting area 11.

The adjustment device 511 does not interfere with the tensioning wheel 200 when the rocker 20 is far away from the supporting area 11.

The adjustment device 511 can include a snap device comprising a hook and a gear wheel of the type shown in FIG. 2.

Obviously, other equivalent elements which allow the same technical results to be achieved can be used.

The movement of the tensioning wheel 200 around the main axis 2*a* and the tensioning axis 2*b* can be provided by the first drive member 4.

However, in the preferred embodiment, the movement of the tensioning wheel 200 around the main axis 2*a* is carried out thanks to the first drive member 4, whereas the movement of the tensioning wheel 200 around the tensioning axis 2*b* is carried out thanks to the second drive member 7.

Preferably, the first drive member 4 is adapted to rotate the movement device 510 around the second axis of rotation 5*c*, and therefore also the rocker 20 around the main axis 2*a*.

Preferably, the second drive member 7 is adapted to rotate the second component 501 around the drive axis 5*b*, and therefore also the tensioning wheel 200 around the tensioning axis 2*b*.

The connection between the second drive member 7 and the first drive assembly 50 can be provided directly or indirectly through drive means, for example gears, with one or more stages.

Similarly, as already mentioned, the connection between the first drive member 4 and the second drive assembly 51 can also be provided directly or indirectly through drive means, for example gears, with one or more stages.

Preferably, the transmission of motion from the first drive member 4 to the second drive assembly 51 of the first drive mechanism 5, in particular to the movement device 510, is provided by a part of a second drive mechanism 6 described hereafter.

In any case, the second drive member 7 is preferably adapted to actuate the movement of the second component 501 around the drive axis 5*b*.

Furthermore, as subsequently described, the second drive member 7 is preferably adapted to move, in addition or alternatively, part of the welding assembly 3, and in detail, particularly the welder 300.

In detail, the second drive member 7 is therefore operatively connected to the welder 300 especially, but not exclusively, when the latter is independent of the interface device 30.

The second drive member 7, therefore, is preferably operatively connected to at least part of the tensioning assembly 2 and part of the welding assembly 3. In particular, the second drive member 7 is indirectly operatively connected to the tensioning assembly 2 by means of part of the first drive mechanism 5, in particular the first drive assembly 50.

Therefore, the second drive member 7 is adapted to actuate at least part of the tensioning assembly 2. Preferably, the second drive member 7 actuates the movement of the second component 501 around the second drive axis 5*b*.

In particular, in order to transmit motion from the second drive member 7 to the first component 501, a direct connection between the drive shaft of the second drive member 7 and the second component 501 can be provided. Or, preferably, the first component 5 includes a third component 503.

The third component 503 is preferably operatively connected to the second component 501 and the second drive member 7. In fact, the third component 503 is configured to transmit the movement of the second drive member 7, for example the shaft or a gear or crown which moves integrally with the shaft, to the second component 501 so as to rotate the second component 501 around the drive axis 5*b*. Preferably, the third component 503 is also centred with respect to the first axis of rotation 5*a*.

Preferably, therefore, in the preferred embodiment, the third component 503, the second component 501 and the tensioning wheel 200 include gears arranged in succession and in this order between the first axis of rotation 5*a* and the main axis 2*a* such that the component 501 is interposed between the third component 503 and the tensioning wheel 200.

In other words, for example, the third component 503 and the second component 501, respectively, define the ends of the drive arm, whereas the tensioning wheel 200 and the opposing means 21, respectively, define the ends of the rocker arm. Therefore, preferably, the first component 500 is substantially a lever designed to follow, thanks to the thrust means 502, the rocker 20 while the latter rotates around the main axis 2*a*, wherein the contact is made by means of the second component 501 and the tensioning wheel 200.

The second component 501 rotates integrally with the first component 500 around the first axis of rotation 5*a*.

As already disclosed, the strapping device also includes the second drive mechanism 6.

The second drive mechanism 6 is preferably operatively connected to at least the first drive member 4, at least part of the tensioning assembly 2 and at least part of the welding assembly 3.

Preferably, in fact, the second drive mechanism 6 is preferably adapted to move part of the tensioning assembly 2 and/or part of the welding assembly 3 towards the supporting area 11.

In particular, preferably, the second drive mechanism 6 is adapted to move the rocker 20, and therefore the tensioning wheel 200, towards or away from the supporting area 11 and move the interface device 30, and therefore the welder 300, if it is connected to the interface device 30, towards or away from the supporting area 11. In the preferred configuration, the second drive mechanism 6 can allow the interface device 30 to move towards the supporting area 11 where the welder 300 is constrained, and therefore towards the welder 300 itself.

In particular, as already described, in the preferred embodiment, the second drive mechanism 6 comprises part of the first drive mechanism 5 and, in detail, the part designated to move the tensioning wheel 200 around the main axis 2*a*. In particular, preferably, the drive mechanism 6 comprises the second drive assembly 51.

The second drive mechanism 6 preferably includes at least a first element 60.

The first element 60 is a mobile element, i.e. adapted to occupy different positions with respect to the frame 10. It is preferably operable in such a way as to carry out at least a first movement 60*a* and a second movement 60*b*.

Therefore, the first element 60 preferably defines, in relation to the movements 60*a*, 60*b*, at least one intermediate position with respect to the frame 10.

The intermediate position is preferably the position in which the first element 60 has not been moved either integrally with the first movement 60*a* or integrally with the second movement 60*b*.

Therefore, preferably, the intermediate position is the position starting from which the drive member 4 actuates at least part of the tensioning assembly 2 if the first element 60 carries out the first movement 60*a* and alternately actuates at least part of the welding assembly 3 if the first element 60 carries out the second movement 60*b*.

In other words, the first element 60 is substantially a switch adapted to switch, based on its movement, the transmission of motion from the first drive member 4 between the tensioning assembly 2 and the welding assembly 3.

The first movement 60*a* and the second movement 60*b* can therefore be movements of any kind, for example rotations or translations of the first component 60, as long as they do not coincide. For example, the first movement 60*a* and the second movement 60*b* could be translations along the same path but in opposite directions.

Preferably, the first movement 60*a* and the second movement 60*b* are rotations defining the same path, but opposite directions.

In fact, in the preferred embodiment, the first element 60 defines a switching axis 6*a*.

The switching axis 6*a* is preferably aligned and coincident with the direction defined by the first movement 60*a* and the second movement 60*b* if they are rotations. In detail, preferably, the first movement 60*a* corresponds to a rotation of the first element 60 around the switching axis 6*a* in a first direction, and the second movement 60*b* corresponds to a rotation of the first element 60 around the switching axis 6*a* in a second direction opposite to the first direction.

The switching axis 6*a* can therefore be aligned with or parallel to the drive shaft of the first drive member 4.

In particular, the movements 60*a*, 60*b* can be movements integral with each other and defined by the drive shaft of the drive member 4, or drive means can be provided between the first element 60 and the drive shaft, for example gears with one or more stages, for the transmission of motion from the drive member 4 to the first component 60.

In the preferred configuration, the first element 60 is preferably a device comprising a plurality of elements. In particular, the first element 60 includes a second element 600 and the movement device 510.

The second element 600 is preferably a lever rotating integrally with the first drive member 4 and adapted, when the first element 60 is moved according to the first movement 60*a*, to interfere with at least part of the interface device 30.

In particular, the second element 600 is configured to push the interface device 30 towards the supporting area 11.

The movement device 510, likewise, is preferably a lever moved by the first drive member 4, which interferes with at least part of the rocker 20 only when the second movement 60*b* occurs starting from the intermediate position defined by the first component 60.

In order to be able to make such a mechanism, as in the case of the second element 600, it suffices that the movement device 510 is not directly connected to the rocker, but that it interferes therewith only after the second movement 60*b* starting from the intermediate position.

Preferably, in the intermediate position of the first component 60, the tensioning assembly 2 and the welding assembly 3 define specific positions.

Preferably, in the intermediate position, the tensioning roller connected to the tensioning wheel 200 is adherent to the strap, therefore the tensioning wheel 200 is close to the supporting area 11 and the strap.

Furthermore, in the intermediate position, the welder 300 is far from the strap. Substantially, therefore, the welder 300 is spaced apart from the supporting area 11.

Of course, following the movements 60*a*, 60*b*, extreme positions can be defined. These extreme positions correspond to the positions that can be reached, for example, with a first movement 60*a* or a second movement 60*b*, and beyond which it is not possible to proceed with the same movement, for example due to structural reasons or to the configuration of the first drive member 4.

Preferably, the first element 60 defines a first extreme position following the first movement 60*a* in which the tensioning roller, and therefore the tensioning wheel 200, is far from the strap, i.e. the supporting area 11.

Furthermore, preferably, the first element 60 defines a second extreme position following the second movement 60*b* in which the welder 300 is adherent to the strap, i.e. the welder 300 is close to the supporting area 11.

In order to achieve the aforesaid mechanism, in the preferred but not exclusive embodiment, the first element 60 comprises the second element 600 and the movement device 510.

Figure 8:
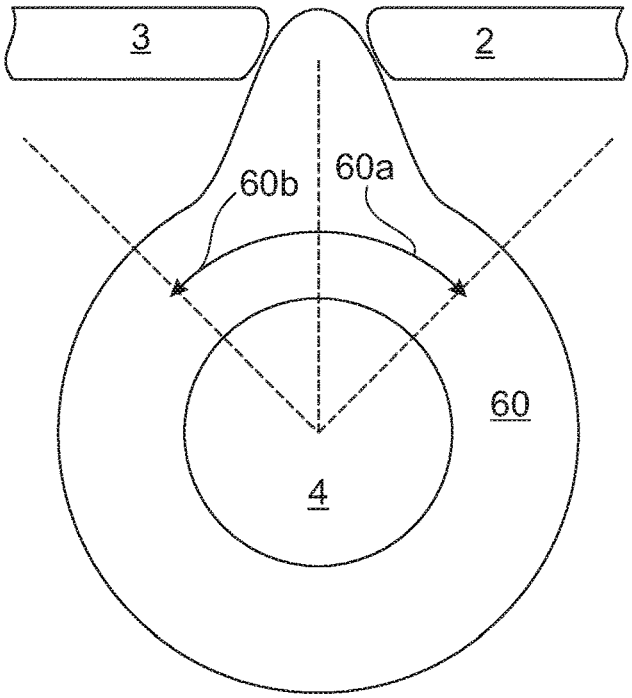
FIG. 8 is an example of a possible first element included in the second drive mechanism of a strapping device according to the invention.

However, in alternative configurations, the strapping device could comprise a first simplified element 60, for example as shown in FIG. 8, i.e. a gear adapted to interfere with part of the welding assembly 3, in particular the interface device 30, when performing the first movement 60*a*, and adapted to interfere with part of the tensioning assembly 2, in particular the rocker 20, when performing the second movement 60*b*.

In particular, preferably, the first element 60, when moved between the intermediate position and the second extreme position, can be connected to the interface device 30 so as to move it, for example, with respect to the secondary axis 3*a*. This result can be achieved, for example, with eccentric gears designed to interfere with the interface device 30 only within predetermined movement ranges.

Similarly, preferably, the first element 60, when moved between the intermediate position and the first extreme position, can be connected to the rocker 20 so as to move it, for example, with respect to the main axis 2*a*.

The operation of the strapping device 1, previously described in structural terms, is as follows.

Basically, the strapping device 1 allows the lowering of the welder 300, the raising of the welder 300, the raising of the tensioning wheel 200 and the lowering of the tensioning wheel 200 with respect to the supporting area 11 on which the strap is located to be actuated in sequence with a single first drive member 4.

Furthermore, the strapping device 1 allows the vibration of the welder 300 to join two edges of the strap to be actuated, or the rotation of the tensioning wheel 200 on its axis to be actuated, by means of a second drive member 7.

Obviously, it is advisable that the tensioner roller be adherent to the strap before actuating the second drive member 7, that is, before tensioning the strap. Moreover, it is advisable that the tensioner roller be adherent to the strap before actuating the second drive member 7 again to weld the strap. However, the invention allows any element to be actuated at any time and position of the interface group 30 and the rocker 20.

As already said, the strapping device 1 can include, as usually occurs in common strapping devices, shearing means suitable for shearing off part of the strap at the end of the working process. Said shearing means may work and have mechanical connections similar to the welder 300.

The strapping device 1 according to the invention achieves important advantages. In fact, the strapping device 1 allows the complexity and the mechanical components inside the control assemblies, i.e. the welding 3 and tensioning 2 assemblies, to be reduced, while maintaining high processing efficiency. In fact, with two drive mechanisms 5, 6, it is possible to provide all possible configurations safely and quickly.

Another major advantage of the invention is that the strapping device 1, thanks to the conformation of the first drive means 5, and in particular of the first drive assembly 50, is able to increase the torque for locking the rocker 20, thus ensuring greater locking stability even in the case of required tension forces greater than the norm.

Figure 9A:
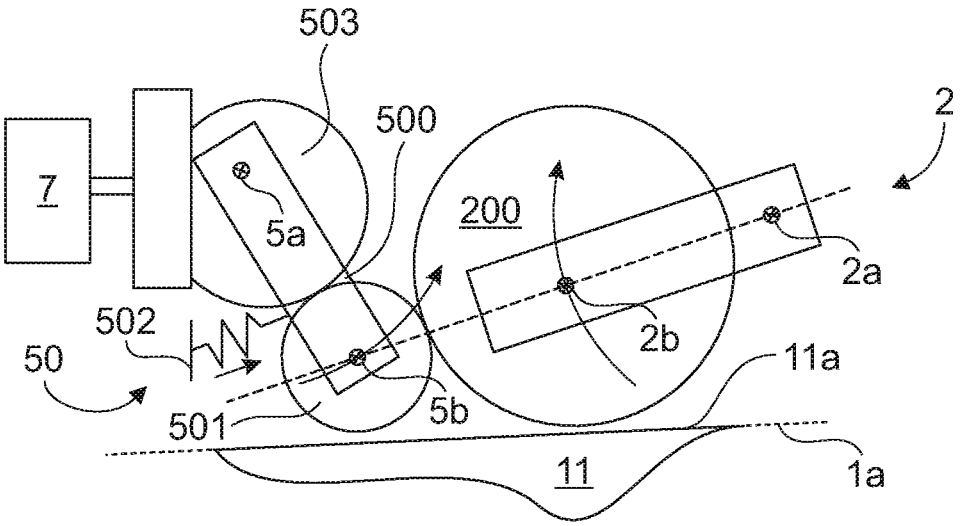
FIG. 9*a* represents a simplified functional diagram referring to the operation of the first drive assembly and the rocker of a strapping device according to the invention, with the rocker close to the supporting area, highlighting the rotations required to move it away.
Figure 9B:
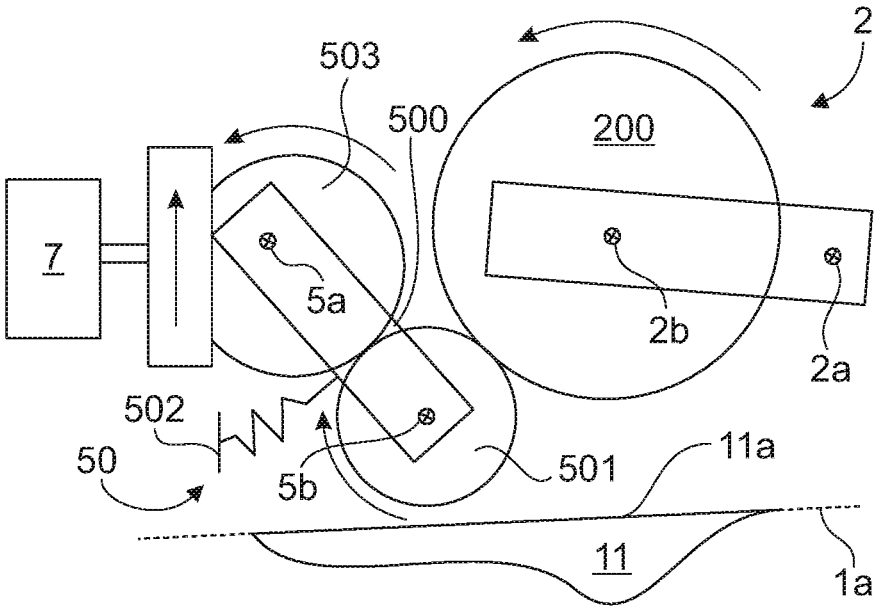
FIG. 9*b* shows a simplified functional diagram referring to the operation of the first drive assembly and the rocker of a strapping device according to the invention, with the rocker close to the supporting area, highlighting the rotations required to rotate the roller on its axis.

In fact, as shown for example in FIG. 9*b*, the rotation of the second component 501 tends to exert a pressure that lowers the rocker 20 towards the supporting area 11. Compared to devices of the prior art, in particular, the drive arm and the rocker arm, which define the moments caused by the lowering pressure or force, are much higher. For this reason, the strapping device 1 is also more stable than common strapping devices.

In conclusion, a further advantage is that the strapping device 1, thanks to the conformation of the second drive mechanism 6, assists the operator during the unlocking of the strap, so as to prevent, or at least reduce, defective and yielding seals. This effect is due to the fact that the strap becomes unlocked only after the return from the extreme position to the intermediate position, which requires a time specifically set to prevent the operator from freeing the strap too early, thereby unintentionally creating yielding points.

The invention is susceptible of variations falling within the scope of the inventive concept as defined by the claims.

In this context, all details are replaceable by equivalent elements, and the materials, shapes and dimensions may be any materials, shapes and dimensions.

The invention claimed is:

1. A strapping device comprising:

a frame defining a supporting area for placing thereon on which a strap being processed, a tensioning assembly suitable to lock and tension, on command, at least part of said strap, a welding assembly for joining, on command, at least two edges of said strap, at least a first drive member suitable to actuate at least part of said tensioning assembly and said welding assembly, and a first drive mechanism operatively connected to at least said first drive member, at least part of said tensioning assembly and said welding assembly, and including at least a first element operable to carry out at least a first movement and a second movement, wherein said first element defining at least one intermediate position with respect to said frame starting from which said first drive member actuates at least part of said tensioning assembly if said first element carries out said first movement and alternately actuates at least part of said welding assembly if said first element carries out said second movement.

2. The strapping device according to claim 1, wherein said first element defines a switching axis, and said first movement corresponds to a rotation of said first element around said switching axis in a first direction and said second movement corresponds to a rotation of said first element around said switching axis in a second direction opposite to said first direction.

3. The strapping device according to claim 1, wherein said tensioning assembly comprises at least one rocker comprising at least one tensioning wheel and suitable to be moved with respect to said frame towards said supporting area, to arrange said tensioning wheel close to said strap, or far from said strap, and wherein in said intermediate position said tensioning wheel is close to said strap.

4. The strapping device according to claim 3, wherein said welding assembly comprises at least one interface device comprising at least one welder suitable to produce heat to join together said edges of said strap and suitable to be moved with respect to said frame towards said supporting area, in such a way as to arrange said welder adherent to said strap, or far from said strap, and wherein in said intermediate position said welder is far from said strap.

5. The strapping device according to claim 4, wherein said first element defines a first extreme position following said first movement in which said tensioning wheel is far from said strap.

6. The strapping device according to claim 4, wherein said first element defines a second extreme position following said second movement in which said welder is adherent to said strap.

7. The strapping device according to claim 4, wherein said first element comprises a lever rotating integrally with said first drive member and suitable to interfere with at least part of said interface device when the first element is moved according to said first movement, and wherein said first element further comprises a movement device being a lever moved by said first drive member interfering with at least part of said rocker only when said second movement is carried out starting from said intermediate position defined by said first element.

8. The strapping device according to claim 5, comprising a second drive member operatively connected to at least part of said tensioning assembly and said welding assembly, and suitable to actuate at least part of said tensioning assembly and said welding assembly, said rocker defining a main axis, said interface device defining a secondary axis, said tensioning wheel defining its own tensioning axis, said welder defining a vibration axis along which said welder translates cyclically, and wherein said first drive member actuates a movement of said rocker around said main axis and of said interface device around said secondary axis and said second drive member actuates a movement of said tensioning wheel around said tensioning axis and of said welder along said vibration axis.

9. The strapping device according to claim 8, wherein said first drive mechanism comprises a first drive assembly, wherein said first drive assembly comprises first opposing means configured to provide a thrust suitable to allow said first drive assembly to follow said rocker.

10. The strapping device according to claim 2, wherein said tensioning assembly comprises at least one rocker comprising at least one tensioning wheel and suitable to be moved with respect to said frame towards said supporting area, to arrange said tensioning wheel close to said strap, or far from said strap, and wherein in said intermediate position said tensioning wheel is close to said strap.

* * * * *